United States Patent [19]

Wagner et al.

[11] 4,172,307

[45] Oct. 30, 1979

[54] PROCESS AND APPARATUS FOR THE MANUFACTURE OF NON-WOVENS

[75] Inventors: Hans Wagner, Kelkheim; Valentin Semjonow, Hofheim am Taunus, both of Fed. Rep. of Germany

[73] Assignee: Hoechst Aktiengesellschaft, Frankfurt am Main, Fed. Rep. of Germany

[21] Appl. No.: 889,402

[22] Filed: Mar. 23, 1978

[30] Foreign Application Priority Data

Mar. 25, 1977 [DE] Fed. Rep. of Germany ..... 2713241

[51] Int. Cl.[2] ..... D04H 3/02

[52] U.S. Cl. ..... 19/299; 19/304; 28/100

[58] Field of Search ..... 156/181, 441; 19/155, 19/156.4, 296, 299, 304; 28/100, 104, 101; 264/210 F, 176 F

[56] References Cited

U.S. PATENT DOCUMENTS

| | | | |
|---|---|---|---|
| 2,736,676 | 2/1956 | Frickert, Jr. | 156/181 |
| 2,875,503 | 3/1959 | Frickert et al. | 156/181 |
| 3,402,227 | 9/1968 | Knee | 264/24 |
| 3,734,803 | 5/1973 | Lipscomb et al. | 19/299 |
| 3,736,211 | 5/1973 | Lipscomb et al. | 156/441 |
| 3,853,651 | 12/1974 | Porte | 156/181 |

*Primary Examiner*—Michael W. Ball

*Attorney, Agent, or Firm*—Curtis, Morris & Safford

[57] ABSTRACT

For the manufacture of non-wovens, filaments are laid down on a moving surface. The filaments are deflected by means of a rotating deflector and a subsequent guide plate connected thereto. It is important that the rotating deflector deflects the filaments from the rotational axis and that the guide plate rotating synchronously with the deflector leads back at least part of the filaments in the direction of the intersection of the rotational axis and the deposition surface, this leading back being carried out advantageously to a different extent for different portions of the filament veil. This leading back being at least partial results in a considerably more uniform area weight distribution than hitherto obtained.

6 Claims, 7 Drawing Figures

Figures 1, 2, 3:
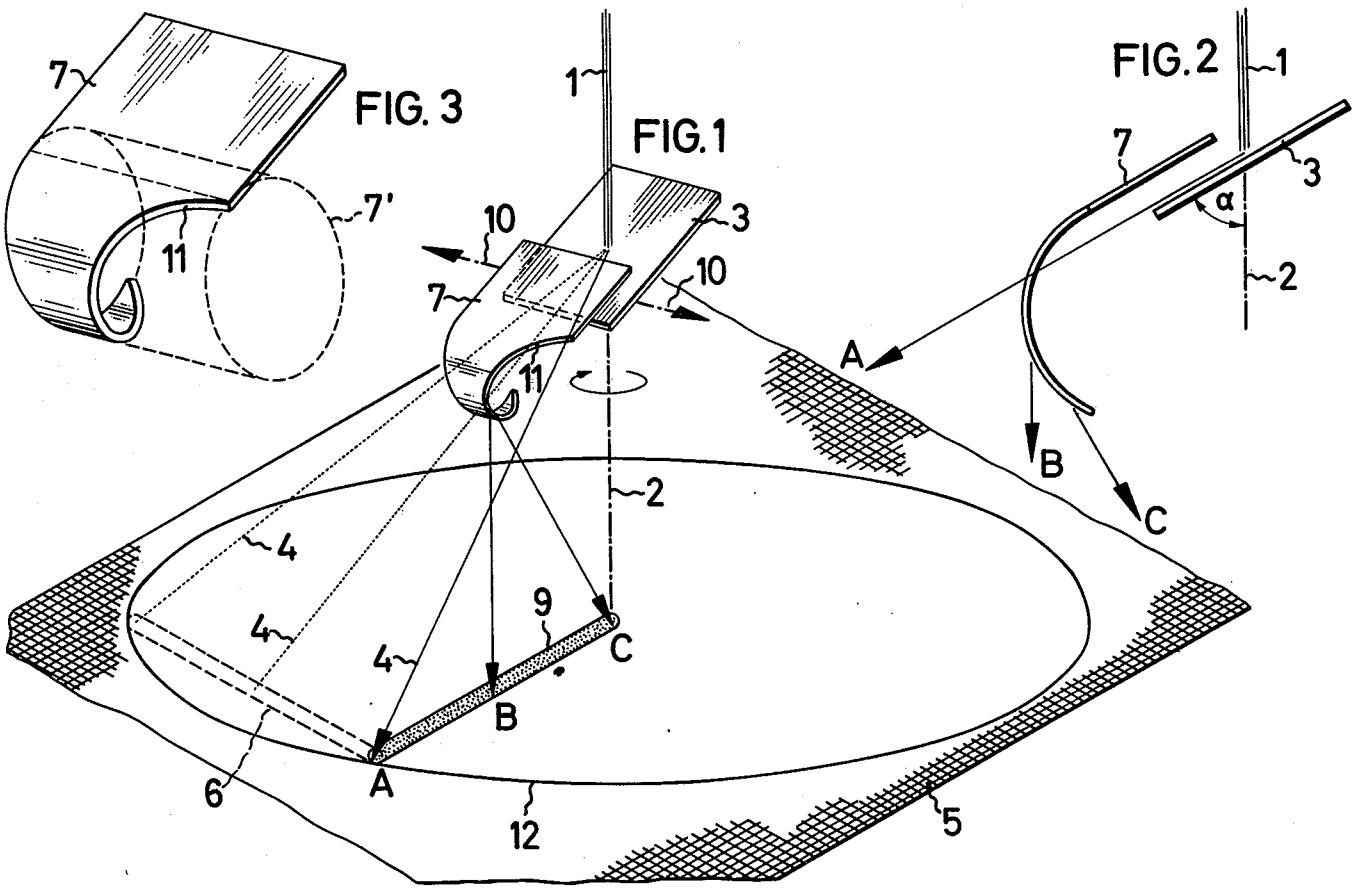

1
2
3
4
5
6
7
7'
9
10
11
12
A
B
C
α

PROCESS AND APPARATUS FOR THE MANUFACTURE OF NON-WOVENS

The present invention relates to a process for laying down filaments on a moving surface to form a non-woven having a defined area weight distribution by deflection of a filament bundle by means of a rotating deflector and a subsequent guide plate connected thereto. The invention relates furthermore to an apparatus for carrying out this process.

Numerous processes and devices are known for the deposition of filaments to form non-wovens. One of the most serious problems to be solved is the distribution of the filament mass in the non-woven, which distribution should be preferably as uniform as possible. The present invention deals with the possibility of controlling the distribution of the filament mass in the non-woven, that is, the realization of a defined, preferably rather uniform, area weight distribution in the non-woven when using a rotating deposition system.

It is known that non-wovens of good uniformity and high strength in all directions may be manufactured by means of rotating deposition systems. Copending U.S. application Ser. No. 642,400 filed Dec. 19, 1975 describes a process for the manufacture of a non-woven on the basis of filaments, according to which the filaments or filament bundles are deflected by rotating deflectors having a plane impinging zone, scattered and collected on a moving surface. This patent application discloses furthermore that the distribution of the filament mass in the non-woven can be influenced by a helical design of the deflector below the point of impact of the filament bundle.

German Offenlegungsschrift No. 22 00 782, too, proposes a process by means of which filaments are laid down in rotating movement to yield a non-woven. For spreading out the filaments to form a non-woven, the centrifugal forces which develop are utilized in this case.

Japanese Patent Publication Sho 48-41785 discloses a device for the manufacture of non-wovens, by means of which filaments are laid down also in rotating movement. Furthermore, devices laying down filaments in circular manner are mentioned in U.S. Pat. No. 3,756,893 and French Pat. No. 20 45 331.

In these processes and apparatus which provide vertical feed of the filament bundle, vertical arrangement of the rotational axis of the deflecting mechanism and horizontal area of deposition, a circular filament deposit is formed in which the filament mass laid down is arranged with rotational symmetry in such a manner that the substantial part of the filament mass forms an annular mound near the rim of the circular deposit. When the collector surface is moving this distribution of the filament mass in the deposit on a moving collector surface does not yield the trapezoidal area weight profile in the non-woven tape laid down, as it is intended above all. According to the cited state of the art, indications as to a satisfactory realization or modification of the filament mass distribution in the circular deposit in order to meet requirements such as for example high uniformity of the non-woven are nonexistent or completely insufficient. These properties cannot be attained by deposition systems where practically no filaments at all are laid down in the center of the circular deposit.

U.S. Pat. No. 3,402,227 discloses laying down filaments to form a trapezoidal deposit by using a slit nozzle, and claims to attain a certain control of the shape of the filament deposit by using a permeable, perforated conveyor belt in combination with the suction air. However, the cited means for guiding the filaments to a defined place in the deposit are insufficient.

It is therefore the object of the present invention to provide a deposition process which is free from the above disadvantages and which makes it possible to guide the filaments to places in the deposit where they are required in order to obtain a, preferably, very uniform non-woven.

In accordance with the present invention, this object is achieved in the following manner: the rotating deflector deflects the filaments from the rotational axis, and the subsequent guide plate turning synchronously with the deflector deflects at least part of the filaments in the direction to the intersection of the rotational axis and the deposition surface.

It is especially advantageous to see to it that not all of the filaments are deflected back to the same extent by the guide plate in the direction of the intersection of the rotational axis and the deposition surface, but that part of them is deflected back more heavily and part of them less, as it is required for the intended area weight distribution.

The process is carried out using an apparatus which consists of a rotating deflector, a guide plate connected thereto, and a deposition surface. In the apparatus the plane surface of the deflector intersects that of the corotating guide plate at an angle less than 60°, the guide plate is curved in the direction of the deposition surface and, optionally, the rotational axis; and the guide plate is pointed on the end which is turned away from the deflector.

The process of the invention allows the processing of all textile materials in the form of filaments, especially filaments of polyesters, polyamides, polyolefins, polyacrylonitrile, or blended or compound filaments.

Figures 4A, 4B, 4C, 5:
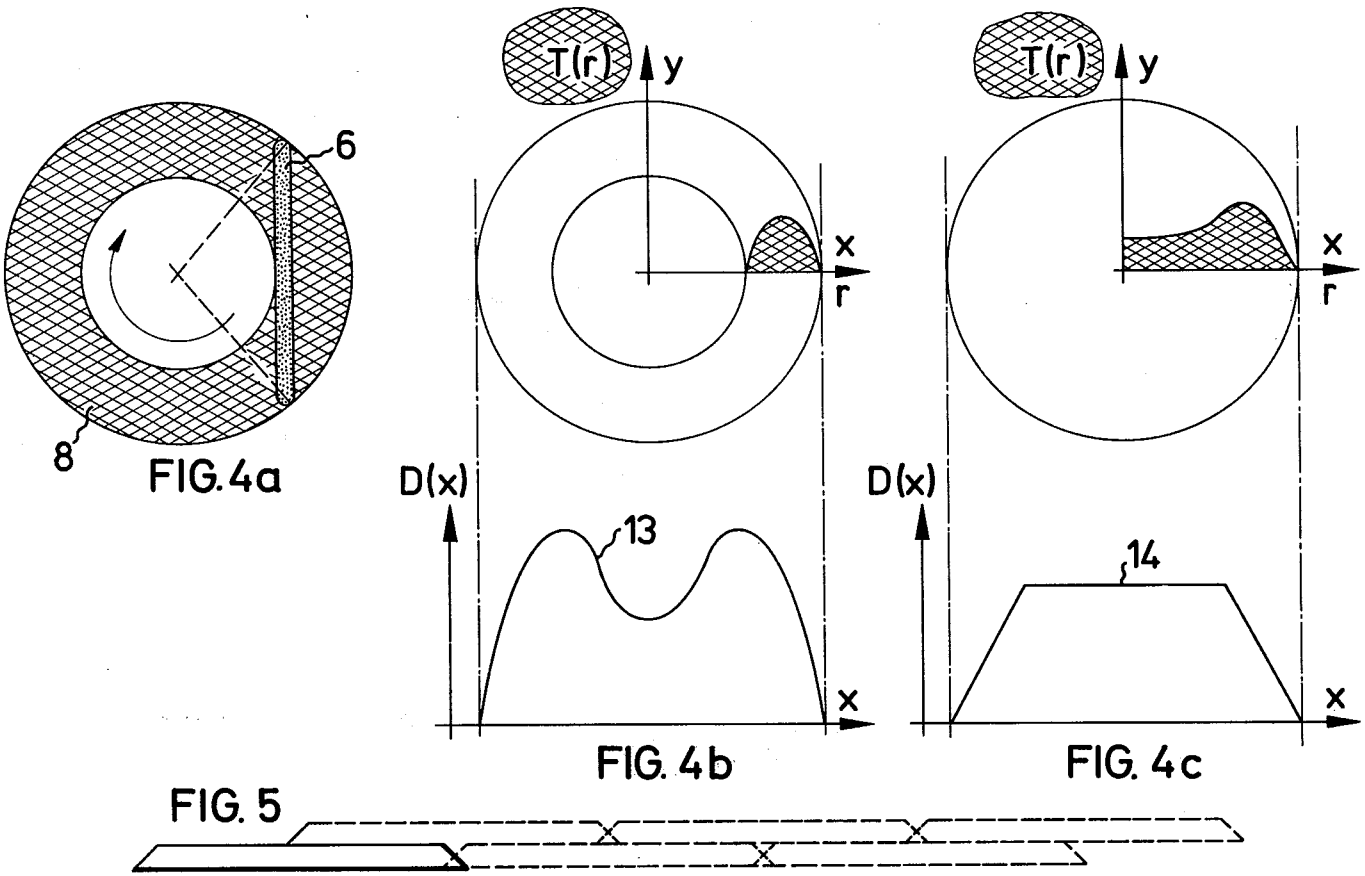

The invention will be better understood by reference to the accompanying drawings, of which FIG. 1 is a perspective view of an apparatus demonstrating the process of the invention, FIG. 2 represents deflector, guide plate, filament bundle and filament veil, as well as the possible variations in leading back of the individual sectors of the filament veil, FIG. 3 shows a guide plate, FIG. 4*a* represents the ground plane of a filament deposit in the form of a circular mound (not in accordance with the invention), FIG. 4*b* in its upper part, shows the distribution of the area weight in the filament deposit on standstill of the deposition surface, and, in its lower part, the corresponding distribution of the area weight in the non-woven laid down on a moving deposition surface (not in accordance with the invention), FIG. 4*c*, in its upper part, shows the ideal distribution according to the invention of the filament mass in the deposit on standstill of the deposition surface, and, in its lower part, the corresponding distribution of the filament mass or the area weight plotted against the cross-section of the non-woven on a moving deposition surface, and FIG. 5 represents a schematic view of a very uniform non-woven which consists of several tapes laid down one beside the other in overlapping manner, each one showing the ideal trapezoidal distribution of the area weight.

The filaments to be processed are fed directly from a spinnert or a filament reservoir in the form of a bundle or strand which has a titer of from 10 to 20,000 dtex, preferably 100 to 2,000 dtex.

The individual filament titer is from about 0.5 to 50 dtex, preferably 1 to 20 dtex. The feeding operation may be combined with a drawing or other treatment of the filament bundle. As shown in FIG. 1, the filament bundle 1, which is adjusted to a speed of from 100 to about 10,000 m/min, preferably 2,000 to 8,000 m/min, by means of, preferably a gas nozzle in filament-axial direction, is generally vertically fed from above to a deflector 3 which rotates around an axis 2 at 0.5 to about 100 revolutions per second, preferably 5 to 50 rps, and which is preferably flat, but may be alternatively curved. The rotational axis of the deflector is generally vertical, so that it is identical with the longitudinal axis of the filament bundle hitting the plate.

FIG. 2 shows that the deflector has a clearance angle $\alpha$ relative to the rotational axis and the axis of the filament bundle hitting the plate, which angle may be from 10° to 80°, preferably from 30° to 70°.

The filament bundle hitting the deflector at high speed is scattered to form a flat ribbon or veil 4 which would hit the deposition surface 5 in the form of track 6 if the guide plate 7 as shown in FIGS. 1 and 2 was not present. Without this guide plate during rotation of the deflector around its axis, track 6 would spread over an annular area 8 as shown in FIG. 4*a*, and a filament deposit having the shape of an annular mound would form on this area 8.

FIG. 4*b* shows in its upper part a diagram which demonstrates the dependence of the area weight T(r) or T(x,y) on the distance r to the center of the filament deposit in this case, y is the coordinate of the conveying direction of the non-woven, and x is in vertical position thereto.

When the deposition surface is moving, a non-woven tape forms the area weight D(x) of which is not uniformly distributed over the cross-section of the non-woven as this is demonstrated in the lower part of FIG. 4*b*. The dependence of D(x) on T(r) or T(x,y) is given by the following relation $$D(x) = \int T(r)dy$$

This distribution of the filament mass in the non-woven laid down has not the intended trapezoidal shape by which a uniform non-woven is distinguished.

Surprisingly, it has been observed that by leading back at least part of the filament veil in the direction of the intersection of the rotational axis 2 of deflector 3 and the deposition surface 5 the distribution of the filament mass in the filament deposit can be influenced and a very uniform trapezoidal arrangement of the filament mass in the cross-section of the non-woven can be obtained. This deflection is achieved advantageously by means of a guide plate which, apart from a certain adjustability, is solidly connected to the deflector. The function of a guide plate 7 is shown in FIGS. 1 and 2. A perspective view of a preferred guide plate is shown in FIG. 3, which guide plate may consist of a rectangular plane part being continued seamlessly to a curved part which, when laid down into a flat plane yields approximately a triangle. This curved surface in FIG. 3 has the curviture of a (broken-line) cylinder jacket 7' the cylinder axis being in parallel position to the edge of the rectangular part of the guide plate. Advantageously, the guide plate is preferably made of metals, glass or plastic materials.

In a further preferred embodiment, the curved part of the guide plate has a spoon-like, spheric shape. Alternatively, the flat part of the guide plate may be entirely abandoned.

After having left the deflector, the filament veil is captured at least in part by the guide plate and led back in a manner as shown for example in FIG. 1, where the flat part of the guide plate is in parallel position to the plane surface of the deflector. Alternatively, it may form an angle with the plane surface of the deflector. The filament veil hits the guide plate at an angle of from 0° to about 60° on the plane and/or curved part thereof. In FIG. 1, the sector of the veil at the far right (arrow A) does not touch the guide plate and is forwarded directly in a straight line to deposition surface 5. The sectors in the middle of the veil, however, are led back by the guide plate in the direction of arrow B. The sector C of the veil at the far left is led back in such a manner that it hits the deposition surface near the intersection of the rotational axis and the deposition surface, that is, near the center of the filament deposit.

This secondary leading back of the filaments shifts track 6 of FIG. 1 in such a manner that, on standstill of the deposition surface, it has now an approximately radial direction (9), relative to the circular filament deposit.

While maintaining its spatial orientation, the guide plate may be shifted horizontally in the direction of arrows 10, so that control can be exercised on the portion of the filament veil which is led back and how far in the direction of the center of the deposit this portion is deflected back.

The guide plate may alternatively be rotated around a vertical axle (not shown in the drawings), for example in order to adjust the guide plate in such a manner that the sector of the filament veil passing over the tip of the guide plate is led back to the spot where the rotational axis of the deflector intersects the desposition surface. In principle, any adjustment of the guide plate is possible in order that the intended filament deposit is ensured.

By adjusting the position and shape of the guide plate, the manufacturer of non-wovens is able to distribute continuously the filament mass between the circumferential limits and the center of the filament deposit. Only a small amount of filaments is needed in the center of the deposit, the guide plate of FIG. 1 is shifted to the left or the pointed end of it which is directed towards the center of the deposit is kept narrow; when a high area weight is required in the center of the deposit, the guide plate of FIG. 1 is shifted to the right, or the pointed end of the plate is given a broader shape.

The filament discharge edge 11 of the guide plate which has a helical shape in FIG. 3 may have any shape and can be used for forwarding the individual sectors of the filament veil to defined places of the filament deposit. A corresponding spheric curvature of the guide plate allows furthermore to lay down the filament veil in such a manner on the deposition surface 5 of FIG. 1 that its track 9 is precisely radial. If necessary, the filament discharge edge of the guide plate may have the form of steps.

For example, when a non-woven having a trapezoidal arrangement of the filament mass over its cross-section is to be obtained, a mass distribution T(r) in the filament deposit is required on standstill of the deposition surface as it is shown in the diagram of the upper part of FIG. 4c. Shape and adjustment of the guide plate is chosen accordingly and determined empirically or computationally; calculation and empirical method being in good agreement.

The process of the invention is furthermore suitable for the manufacture of large non-wovens by simultaneously laying down non-woven tapes one beside the other in overlapping manner. The structure of such a non-woven is shown in FIG. 5.

The following comparison of an Example according to the state of the art and an Example in accordance with this invention illustrates the invention.

EXAMPLE 1

(State of the Art, Without Guide Plate)

Polyethylene terephthalate is spun according to the melt spinning process from a spinneret having 92 circular holes, and the filament bundle is taken off vertically downward by means of an air nozzle, and drawn. After drawing, the individual filaments of the bundle have a titer of 4 dtex. The filament bundle accelerated to a speed of 85 m/sec and accompanied by an air jet is forwarded, as shown in FIG. 1, to a plane deflector having a width of 40 mm and a length of 60 mm which turns at 15 rps. The clearance angle of the deflector, that is, the angle between the deflector and its rotational axis which is identical to the longitudinal axis of the filament bundle hitting the deflector, is 60°. The angle formed at the point of impact by the opening filament veil is 60°, too. The guide plate 7 as shown in FIGS. 1 and 2 is not used, so that the filament veil formed on the deflector hits the deposition surface in track 6. A sieve web is used as deposition surface, through which air is sucked downward at a speed of 4 m/sec in order to hold the depositing filaments on the deposition surface. On standstill of the belt, a circular mound of filaments having an outer diameter of 400 mm and an inner diameter of 150 mm is formed.

When the continuous belt is moving at a speed of about 8 m/min, a non-woven tape having a width of 400 mm is formed. The area weight distribution of this tape, being vertical to the direction of the moving belt, is characterized by two lateral maxima (see diagram 13 in FIG. 4b).

In order to obtain a large non-woven, six filament bundles instead of only one are laid down simultaneously by means of six deposition devices positioned one beside the other at a lateral distance of 200 mm.

By combining six deposits, a non-woven having a width of 1.20 m and a mean area weight of 115 g/m$^2$ is obtained. The uniformity of the area weight so attained is characterized by the difference of the area weight between the heaviest and lightest 5×5 cm sample, which can be found relative to the average value of area weight (ratio of the width at the foot of a distribution to its average value), and it is 0.45, in other words: the area weight at the thinnest spots of the non-woven is lower by about 23%, and at the thickest spots it is higher by about 22% than the over-all average value of 115 g/m$^2$.

EXAMPLE 2

(According to Invention, With Guide Plate)

Operations for the manufacture of a non-woven are as described in Example 1; however, the filament veil leaving the deflector is guided back in such a manner that it hits the deposition surface, that is the sieve web, in track 9. Leading back is ensured by a guide plate having approximately the shape of guide plate 7 of FIGS. 1 and 3, and approximately the spatial position relative to the deflector as shown in FIG. 1.

The rectangular flat part of the guide plate is arranged at a distance of 8 mm above and parallel to the deflector. The horizontally positioned end of the rectangular part of the guide plate, which end is most adjacent to the point of impact of the filament bundle on the deflector, has a width of 50 mm, and the other end of the rectangular part has a length of 15 mm. The curved part of the guide plate into which the rectangular part merges is a section of the surface of a cylinder having a radius of 30 mm. The axis of this hypothetical cylinder is positioned horizontally and simultaneously parallel to that end of the flat part of the guide plate which has a width of 50 mm. When laid down into a flat plane the curved guide plate is a rectangular triangle, one of the small sides of it (having both a length of 50 mm) forms the line of contact with the plane part. The average distance between the point of impact of the filament bundle on the deflector and the track of impact of the filament veil on the guide plate is about 52 mm. The direction of rotation of the deflector and the guide plate solidly connected thereto is chosen in such a manner that the part of the filament veil which is led back towards the rotational axis to a great extent advances the rotating movement.

The guide plate may be shifted horizontally in the sense of arrows 10 of FIG. 1, relative to the deflector, and it is adjusted in such a manner that the trapezoidal distribution of the area weight in the cross-section of the non-woven on the moving deposition surface as shown in diagram 14 of FIG. 4c is obtained. The area weight may be determined in simple manner, for example by photometric means. When adjusting the guide plate, care has to be taken that the filament veil led back leaves the guide plate via the filament discharge edge only, which is shown in FIGS. 1 and 3 sub 11.

When simultaneously laying down six non-woven tapes one beside the other, a non-woven having a width of about 1.20 m and a considerably improved uniformity is obtained. The maximum variation of the area weight in the non-woven is only ±12%.

These examples prove that the process of the invention allows for the manufacture of non-wovens, the quality of which is superior to that of the state of the art. Apart from an excellent uniformity, the non-wovens have a very high strength in all directions.

The non-wovens manufactured according to the process of the invention may be used for numerous applications, for example as reinforcing layers in roofing sheets, in plastic floor coverings etc. . . . , for the manufacture of needled felts, or in road and water engineering.

What is claimed is:

1. A process for laying down filaments on a moving surface to form a non-woven having a defined area weight distribution by deflection of a filament bundle by means of a rotating deflector and a subsequent guide plate connected thereto, wherein the rotating deflector deflects the filaments from the rotational axis, and the guide plate rotating synchronously with the deflector deflects back at least part of the filaments in the direction of the intersection of the rotational axis and the deposition surface.

2. The process as claimed in claim 1, wherein different portions of the filament veil are deflected back to a varying extent.

3. Apparatus for the deposition of filaments to form a non-woven of defined area weight distribution wherein the filaments are deflected by means of a rotating deflector and a curved guide plate connected thereto, which comprises the plane of the deflector intersecting the plane of the synchronously rotating guide plate at an angle less than 60°, the guide plate being connected to the rotating deflector and curved in the direction of the deposition surface and in the direction of the rotational axis of the rotating deflector and which guide plate approximates the shape of a triangle if straightened out into a flat surface.

4. The apparatus as claimed in claim 3, wherein the curved portion of the guide plate has a spoon-like spherical shape.

5. The apparatus as claimed in claim 3, wherein the guide plate can be independently rotated and adjusted with respect to the rotating deflector.

6. The apparatus as claimed in claim 3, wherein the clearance angle between the rotational axis and the plane of the rotating deflector is in the range of from 10° and 80°.

* * * * *